US005943529A

United States Patent [19]

Miyabe et al.

[11] Patent Number: 5,943,529

[45] Date of Patent: Aug. 24, 1999

[54] PROCESS CARTRIDGE AND ELECTROPHOTOGRAPHIC IMAGE FORMING APPARATUS

[75] Inventors: Shigeo Miyabe, Numazu; Hiroomi Matsuzaki, Mishima; Kazuo Chadani, Shizuoka-ken, all of Japan

[73] Assignee: Canon Kabushiki Kaisha, Tokyo, Japan

[21] Appl. No.: 08/982,462

[22] Filed: Dec. 2, 1997

[30] Foreign Application Priority Data

Dec. 3, 1996 [JP] Japan ..... 8-337494
Nov. 7, 1997 [JP] Japan ..... 9-305747

[51] Int. Cl.[6] ..... G03G 15/00

[52] U.S. Cl. ..... 399/111

[58] Field of Search ..... 399/111, 110, 399/125; 347/138, 152

[56] References Cited

U.S. PATENT DOCUMENTS

| | | | |
|---|---|---|---|
| 5,543,891 | 8/1996 | Setoriyama | 399/111 |
| 5,585,889 | 12/1996 | Shishido et al. | 399/113 |
| 5,638,161 | 6/1997 | Numagami et al. | 399/111 |
| 5,708,922 | 1/1998 | Azuma et al. | 399/111 |
| 5,745,823 | 4/1998 | Goto et al. | 399/111 |
| 5,749,027 | 5/1998 | Ikemoto et al. | 399/111 X |
| 5,768,661 | 6/1998 | Coffey et al. | 399/111 |

FOREIGN PATENT DOCUMENTS 8-179626 7/1996 Japan .

*Primary Examiner*—Arthur T. Grimley
*Assistant Examiner*—Sophia S. Chen
*Attorney, Agent, or Firm*—Fitzpatrick, Cella, Harper & Scinto

[57] ABSTRACT

A process cartridge removably mounted to a main body of an electrophotographic image forming apparatus includes an electrophotographic photosensitive member, a process member for acting on the electrophotographic photosensitive member, and a cartridge frame. The cartridge further includes a first projection guided by the main body when the process cartridge is mounted on or dismounted from the main body, the first projection protruding from one end and being coaxial with the electrophotographic photosensitive member, a guiding second projection projecting from an opposite surface and being coaxial with the photosensitive member, a third guiding projection located substantially above the first projection when the process cartridge is mounted on the main body, and a fourth guiding projection located substantially above the second projection in a state in which the process cartridge is mounted on the main body. The distance between the first projection and the third projection is different from the distance between the second projection and the fourth projection.

26 Claims, 14 Drawing Sheets

PROCESS CARTRIDGE AND ELECTROPHOTOGRAPHIC IMAGE FORMING APPARATUS

BACKGROUND OF THE INVENTION

1. Field of the Invention

This invention relates to a process cartridge and an electrophotographic image forming apparatus.

The electrophotographic image forming apparatus is an apparatus for forming an image on a recording medium by the use of an electrophotographic image forming system. Examples of an electrophotographic image forming apparatus include, for example, an electrophotographic copying apparatus, an electrophotographic printer (such as a laser beam printer or an LED printer), a facsimile apparatus and a word processor. Also, the process cartridge comprises at least one of charging means, developing means and cleaning means and an electrophotographic photosensitive member integrally made into a cartridge, which is removably mountable onto a main body of an electrophotographic image forming apparatus.

2. Related Background Art

An electrophotographic image forming apparatus such as an electrophotographic copying apparatus or a laser beam printer has, for example, a photosensitive drum, and carries out known processes such as charging, exposure and development in succession on this photosensitive drum to thereby form a toner image on the photosensitive drum, and transfers the image onto a recording medium, such as transfer sheet. Thereafter, the step of removing any toner remaining on the photosensitive drum by a cleaning device is executed to form an image.

In recent years, such an electrophotographic image forming apparatus has come to adopt a process cartridge system to achieve compactness and ease of maintenance thereof. This process cartridge system comprises a photosensitive drum and process means acting thereon such as charging means, developing means and cleaning means integrally made into a cartridge, which is removably mountable onto the main body by a user himself.

When the process cartridge is to be mounted or dismounted with respect to the main body, a guide portion provided on a side of the process cartridge may be guided along a guide groove formed in the main body to mount of the process cartridge smoothly.

However, the user may try to mount the process cartridge laterally in reverse or longitudinally in reverse with respect to the main body. Accordingly, means for preventing such incorrect mounting becomes necessary.

SUMMARY OF THE INVENTION

It is an object of the present invention to provide a process cartridge which can be prevented from being wrongly mounted with respect to an electrophotographic main body, and an electrophotographic image forming apparatus.

Another object is to provided a process cartridge removably mounted on a main body of an electrophotographic image forming apparatus, comprising:

an electrophotographic photosensitive member;

process means for acting on the electrophotographic photosensitive member;

a cartridge frame;

a first projection guided by the main body when the process cartridge is mounted on or dismounted from the main body, the first projection protruding outwardly from one end surface of the cartridge frame which intersects the axial direction of the electrophotographic photosensitive member to be coaxial with the electrophotographic photosensitive member;

a second projection guided by the main body when the process cartridge is mounted on or dismounted from the main body, the second guide projecting from the other end surface opposite to the one end surface of the cartridge frame which intersects with the axial direction of the electrophotographic photosensitive member to be coaxial with the electrophotographic photosensitive member;

a third projection guided by the main body when the process cartridge is mounted on or dismounted from the main body, the third projection protruding outwardly from the one end surface of the cartridge frame to be located substantially above the first projection in a state in which the process cartridge is mounted on the main body; and a fourth projection guided by the main body when the process cartridge is mounted on or dismounted from the main body, the fourth projection protruding outwardly from the other end surface of the cartridge frame to be located substantially above the second projection in a state in which the process cartridge is mounted on the main body;

wherein the distance between the first projection and the third projection is different from the distance between the second projection and the fourth projection.

Other objects and features of the present invention will become more fully apparent from the following detailed description taken in conjunction with the accompanying drawings.

DESCRIPTION OF THE PREFERRED EMBODIMENTS

An embodiment of the present invention will hereinafter be described with reference to the drawings.

In the present embodiment, the lengthwise direction refers to a direction perpendicular to the mounting-dismounting direction of a process cartridge and parallel to that surface of a recording medium on which an image is formed. Also, the terms left and right refer to the left and right respectively when the mounting direction of the process cartridge is seen from above it. In the following description, a laser beam printer is shown as a form of an electrophotographic image forming apparatus. This laser beam printer, as will be described later, permits a process cartridge to be mounted and dismounted with respect thereto.

The process cartridge and the laser beam printer will first be described with reference to FIGS. 1 to 12.

Here, as the order of description, the general construction of the laser beam printer and the process cartridge will first be described, and then the construction of a photosensitive drum in the process cartridge and the surroundings thereof will be described.

[General Construction]

Figure 1:
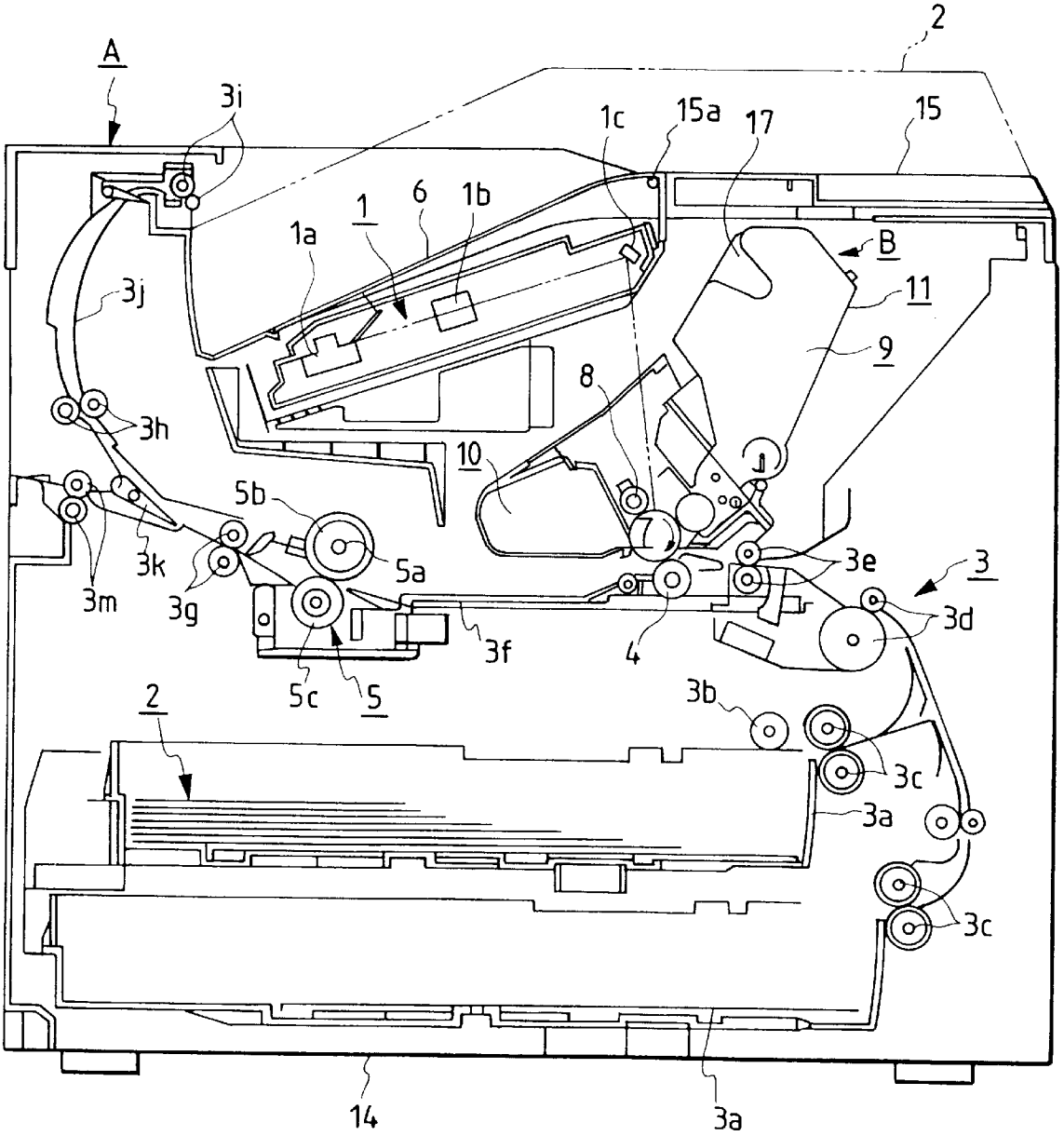
FIG. 1 is a longitudinal cross-sectional view of a laser beam printer.
Figure 2:
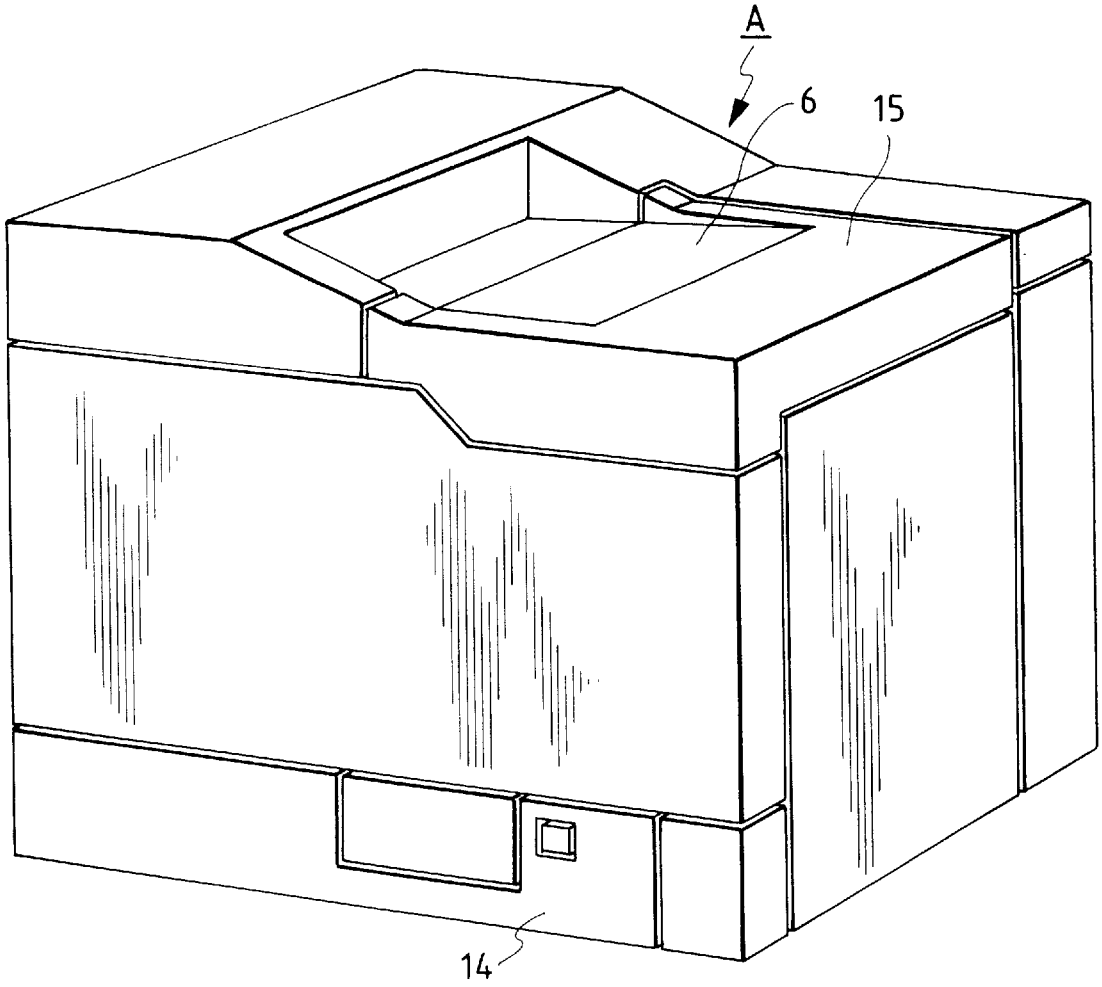
FIG. 2 is a pictorial perspective view of the laser beam printer.

In this laser beam printer A, as shown in FIG. 1, light emitted from a laser source in conformity with image information is scanned by a rotating polygon mirror 1*a*. This scanned light enters optical means 1 having a lens 1*b* and a reflecting mirror 1*c*. An optical image based on the image information is applied from the optical means 1 to a photosensitive drum 7 as an electrophotographic photosensitive member to form a toner image.

In synchronism with the formation of the toner image, a recording medium 2 such as transfer sheet is reversed and conveyed from a cassette 3*a* by conveying means 3 comprising a pickup roller 3*b*, a pair of conveying rollers 3*c* and 3*d* and a pair of register rollers 3*e*. Also, in an image forming portion made into a process cartridge B, the toner image formed on the photosensitive drum 7 is transferred onto the recording medium 2 by a voltage being applied to a transfer roller (transfer means) 4.

Further, after the transfer of the toner image, the recording medium 2 is conveyed to fixing means 5 comprising a fixing roller 5*b* containing a heater 5*a* therein and a driving roller 5*c* for pressing the recording medium 2 against the roller 5*b* and conveying it while the recording medium 2 is guided by a guide member 3*f* to fix the transferred toner image on the recording medium 2. This recording medium 2 is then conveyed by pairs of discharge rollers 3*g*, 3*h* and 3*i* and discharged into a discharge portion 6 through a reversing conveyance route 3*j*. Regarding the discharge, it is also possible to operate a pivotally movable flapper 3*k* and discharge the recording medium straight by a pair of discharge rollers 3*m* without the intermediary of the reversing conveyance route 3*j*.

Figure 3:
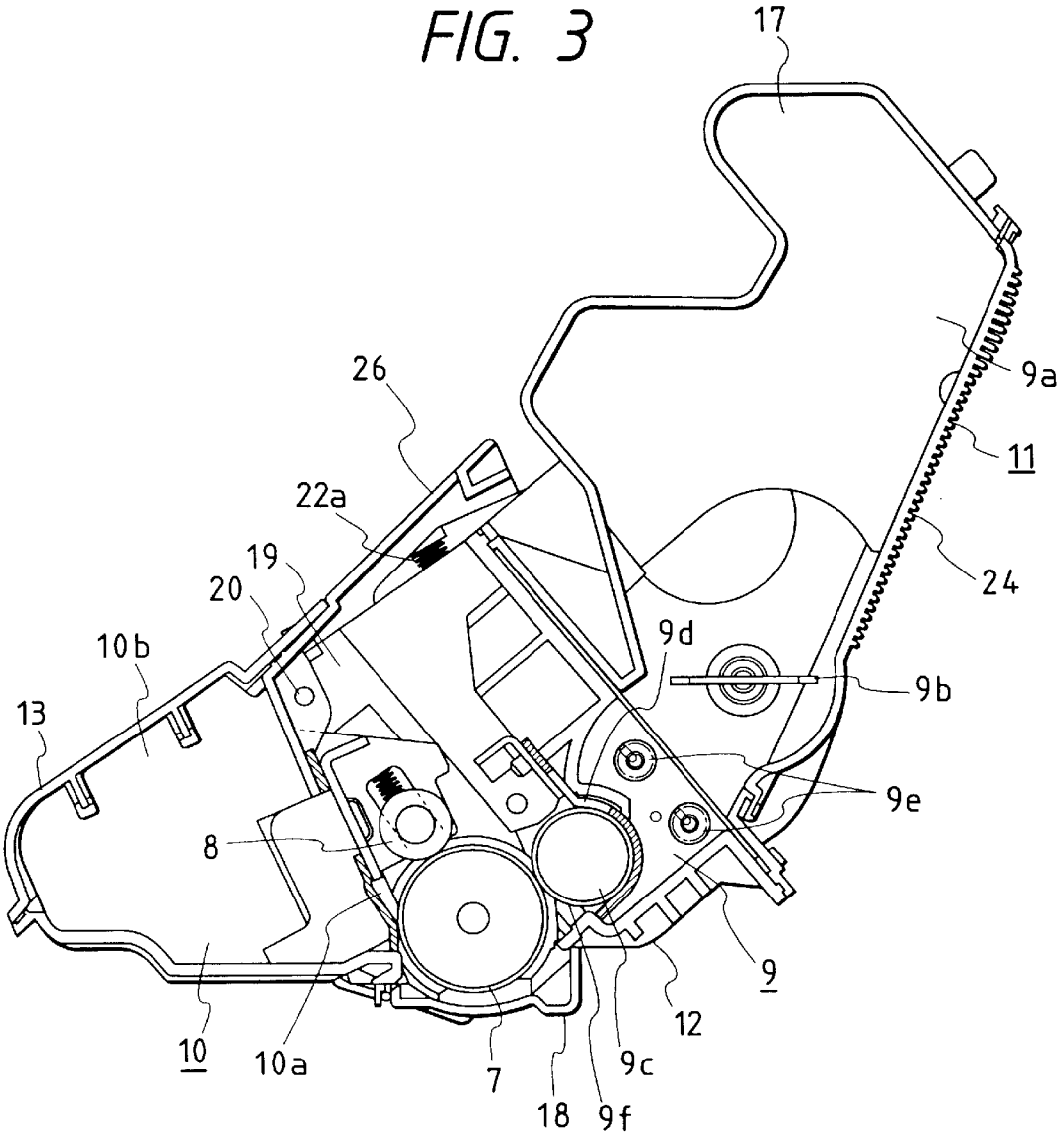
FIG. 3 is a longitudinal cross-sectional view of a process cartridge.

On the other hand, the process cartridge B constituting the image forming portion has the photosensitive drum 7 having a photosensitive layer and rotated by a drive force from the main body of the laser beam printer A, as shown in FIG. 3. The surface of this photosensitive drum 7 is uniformly charged by a voltage being applied to a charging roller (charging means) 8, and the photosensitive drum 7 is exposed to an optical image from the optical means 1 through an exposure opening 26 to thereby form a latent image thereon, and then the latent image is developed by developing means (a developing device) 9.

The developing means 9 feed out a toner in a toner containing portion 9*a* by a toner feeding member 9*b*. A developing roller 9*c* containing a fixed magnet therein is then rotated, and a toner layer having frictional charging charges imparted thereto by an agitating member 9*e* and a developing blade 9*d* is formed on the surface of the developing roller 9*c*. Further, the toner is transferred to the photosensitive drum 7 in conformity with the latent image to thereby form a toner image.

A voltage opposite in polarity to the toner image is then applied to the transfer roller 4 to thereby transfer the toner image onto the recording medium 2. Thereafter, any toner remaining on the photosensitive drum 7 is scraped off or removed from by a cleaning blade 10*a* to be collected into a waste toner reservoir 10*b*.

A cartridge frame is constructed by coupling a toner container 11 and a developing frame 12 together, and coupling a cleaning frame 13 thereto. The parts such as the photosensitive drum 7, etc. are contained in the cartridge frame and are made into a cartridge. This process cartridge B is removably mounted onto cartridge mounting means provided in the main body 14 of the laser beam printer A.

[Construction of the Housing]

The processing cartridge B constitutes a housing by the toner container 11, the developing frame 12 and the cleaning frame 13 being coupled together, and the construction thereof will now be described.

As shown in FIG. 3, the toner container 11 is formed with the toner containing portion 9*a*, and the toner feeding member 9*b* is mounted thereon. Also, the developing roller 9*c* and the developing blade 9*d* are mounted on the developing frame 12, and the agitating member 9*e* for circulating the toner in the developing chamber is rotatably mounted near the developing roller 9*c*. The toner container 11 and the developing frame 12 are welded together to constitute an integral developing unit.

Also, the photosensitive drum 7, the charging roller 8 and the cleaning means 10 are mounted in the cleaning frame 13. Further, a drum shutter member 18 adapted to cover the photosensitive drum 7 and protect it when the process cartridge B is removed from the main body 14 is mounted to constitute a cleaning unit.

Figure 9:
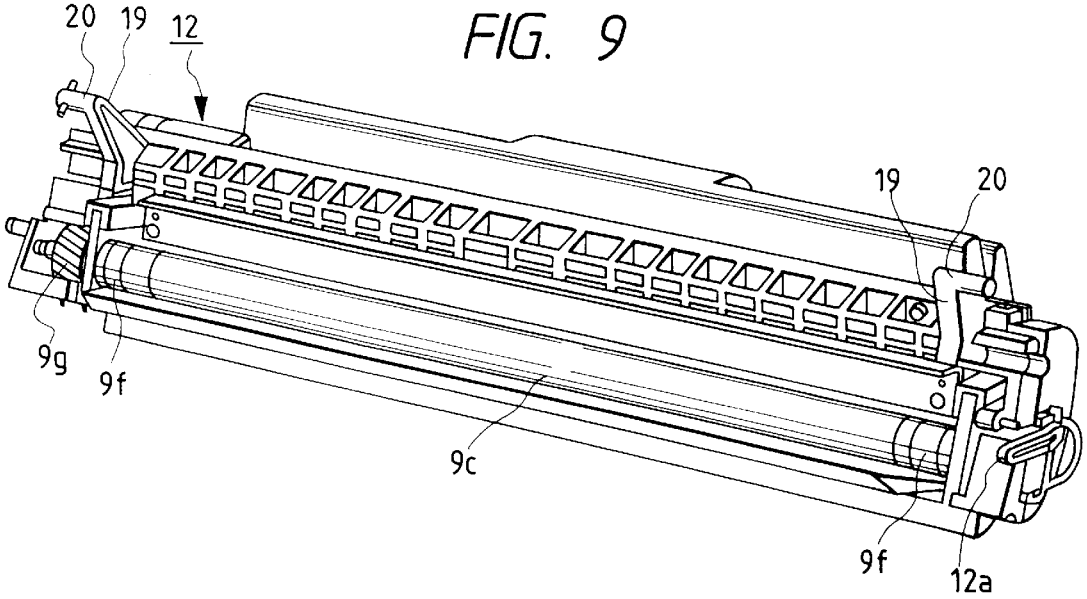
FIG. 9 is a perspective view of a developing unit.
Figure 10:
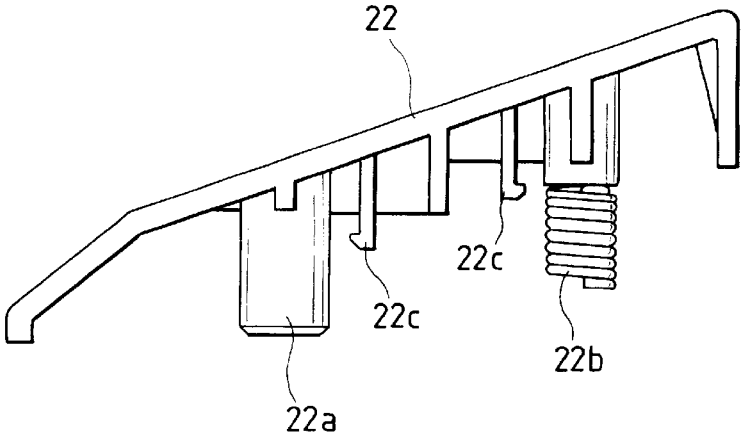
FIG. 10 is a side view of a coupling member.

The developing unit and the cleaning unit are coupled together by a coupling member to thereby constitute the process cartridge B. That is, as shown in FIG. 9, pivot shafts 20 are provided on the tip ends of arms 19 formed on the lengthwisely opposite sides of the developing frame 12. On the other hand, recesses 21 for positioning and restraining the pivot shafts 20 are formed at two locations on the lengthwisely opposite sides of the cleaning frame 13 (see FIG. 8). The pivot shafts 20 are inserted into these recesses 21, and a coupling member 22 integrally having a convex portion 22*a*, a pressing spring 22*b* and a restraining pawl 22*c* is snap-fitted to the cleaning frame 13. Thus, the developing unit and the cleaning unit are coupled together for pivotal movement about the pivot shafts 20, and the developing roller 9*c* is urged against the photosensitive drum 7 by the gravity of the developing unit. At this time, the developing frame 12 is downwardly biased by the pressing spring 22*b* attached to the coupling member 22, to reliably urge the developing roller 9*c* against the photosensitive drum 7. Also, spacer rings 9*f* slightly larger in radius than the developing roller 9*c* are mounted on the lengthwisely opposite sides of the developing roller 9*c*. Therefore, these spacer rings 9*f* are urged against the photosensitive drum 7, and the photosensitive drum 7 and the developing roller 9*c* become opposed to each other with a predetermined spacing (about 300 μm) therebetween.

High accuracy is required of the spacing between the photosensitive drum 7 and the developing roller 9*c* because the spacing is closely related to the light and shade of the image. In the embodiment, the spacing is designed so as to be within about 300 μm±30 μm. That is, the aforementioned spacing is controlled by only the spacer rings 9*f* mounted on the left and right ends of the developing roller 9*c*. Therefore, in the embodiment, the circularity tolerance of the photosensitive drum 7 is selected to be within about 15 μm and the difference between the left and right gaps is within about 15 μm so that no density difference may not be provided. That is, the process cartridge B has a first frame supporting the electrophotographic photosensitive drum and the charging member, and a second frame supporting the developing roller, and the first frame and the second frame are pivotally coupled together.

[Construction of Guide Means]

Figure 4:
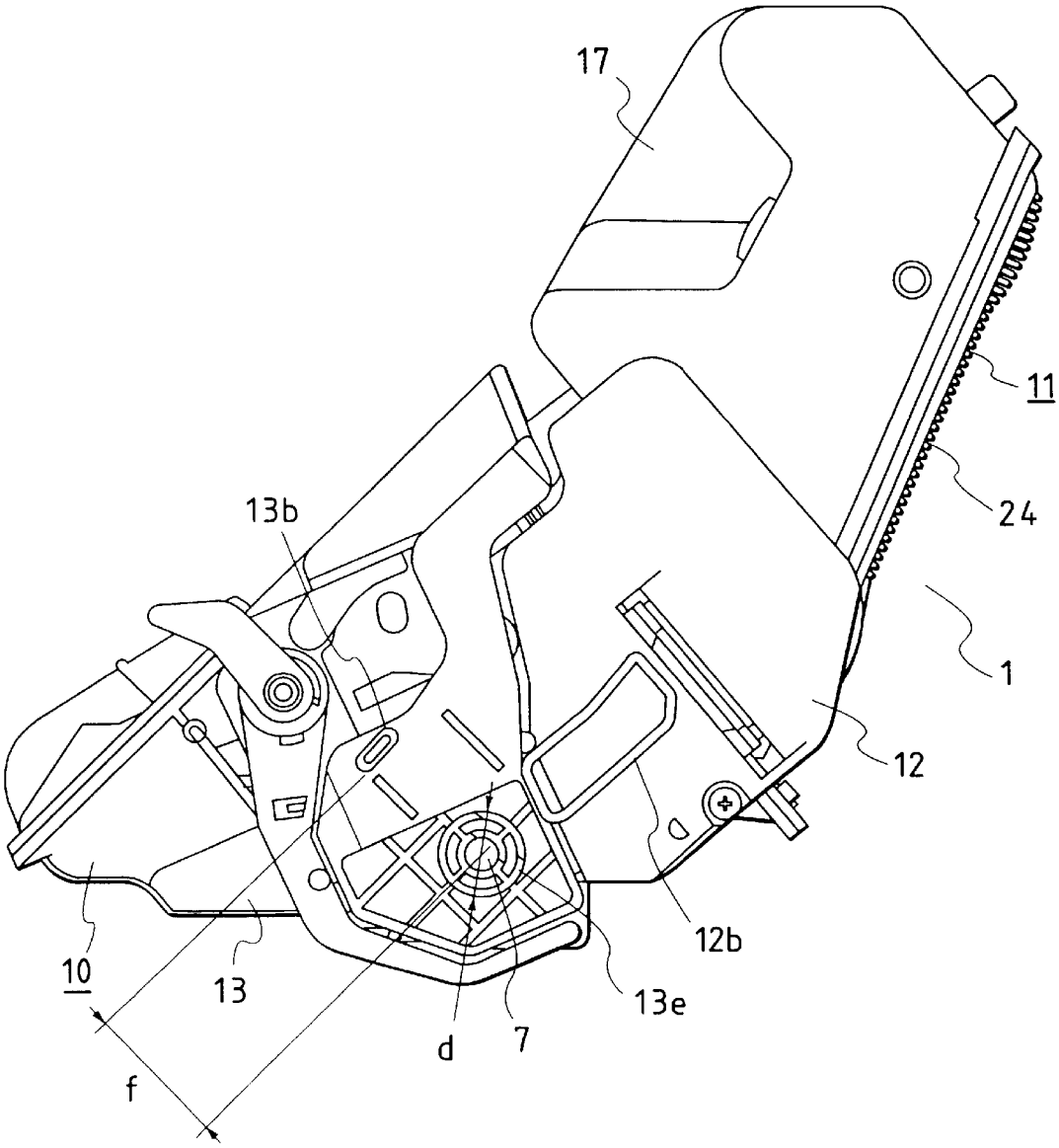
FIG. 4 is a left side surface view of the process cartridge.
Figure 5:
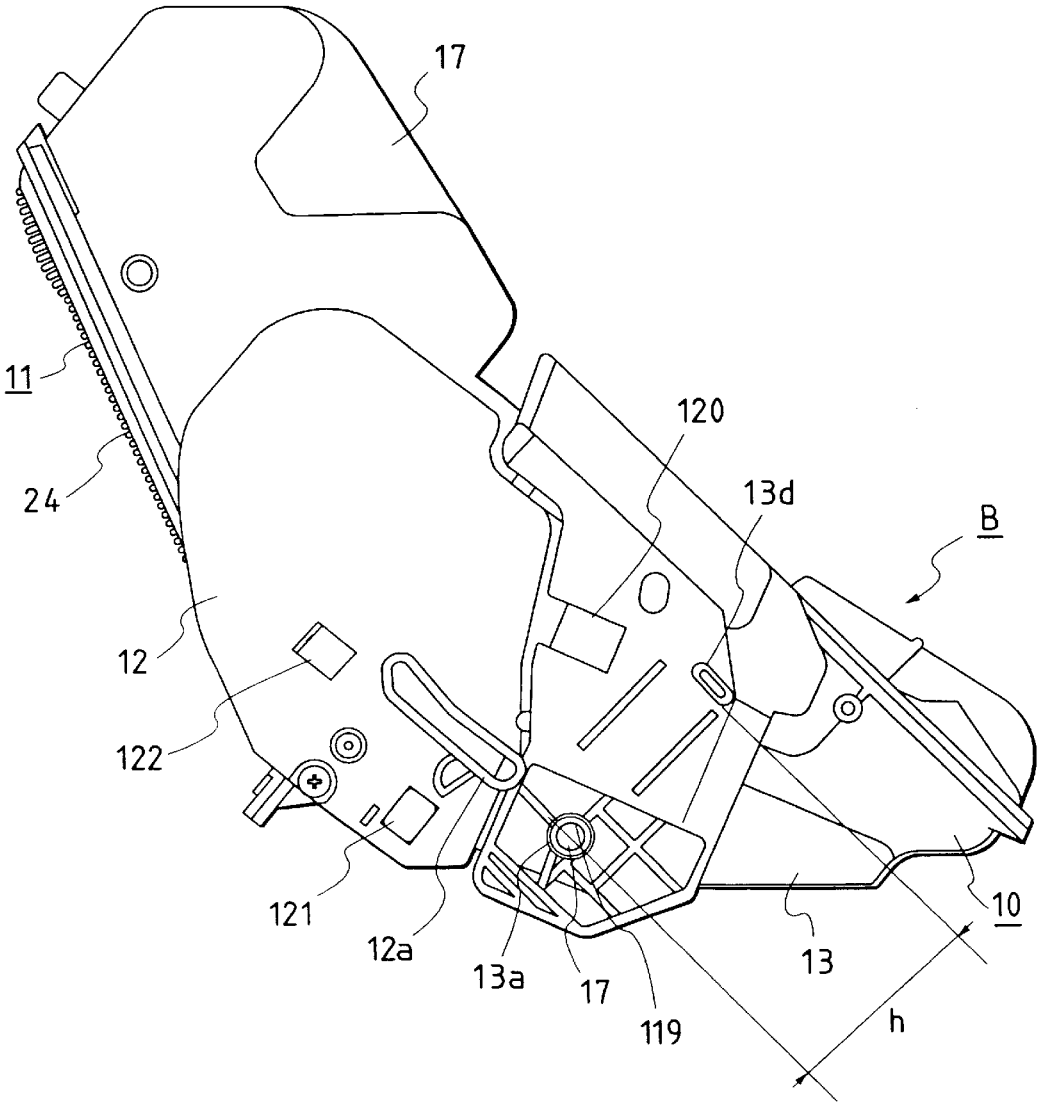
FIG. 5 is a right side surface view of the process cartridge.

FIGS. 4 and 5 are both side views of the process cartridge.

Guided means guided by the main body 14 when the process cartridge B is mounted on or dismounted from the main body 14 are provided on the opposite sides of the housing which is the above-described cartridge frame. This guided means is constituted by dowels 13*a* and 13*e* as first and second projections, lengthwise guides 12*a* and 12*b* as fifth and sixth projections, and short guides 13*d* and 13*b* as third and fourth projections.

The dowels 13*a* and 13*e* are cylindrical members concentric with a drum shaft 17 for supporting the drum shaft 17 supporting the photosensitive drum 7, so that it does not rotate, and are disposed on a side of the cleaning frame 13. Also, the lengthwise guides 12*a* and 12*b* are disposed on a side surface of the developing frame 12 to be astride the continuous side surface of the developing frame 12 and the cleaning frame 13. Further, the short guides 13*d* and 13*b* are shorter than the lengthwise guides 12*a* and 12*b* and are disposed at locations above the dowels 13*a* and 13*e* on a side surface of the cleaning frame 13 (locations substantially above the first and second projections in a state in which the process cartridge B is mounted on the main body (the laser beam printer A)). The dowel 13*a* (13*e*) and the short guide 13*d* (13*b*) are substantially at the same position with respect to the direction in which the process cartridge B is mounted or dismounted with respect to the main body 14. Also, the dowel 13*a* (13*e*) and the lengthwise guide 12*a* (12*b*) are arranged on a line in accordance with the direction in which the process cartridge B is mounted or dismounted.

That is, the first and second projections (dowels 13*a* and 13*e*) are projections guided by the main body when the process cartridge B is mounted or dismounted with respect to the main body, and are projectedly provided on a line coaxial with the axial direction of the electrophotographic photosensitive member (photosensitive drum 7) from the end surface of the cartridge frame (cleaning frame) which intersects with the axial direction of the electrophotographic photosensitive member. Also, the first and second projections are cylindrically shaped.

The lengthwise guides 12*a* and 12*b* extend in the insertion direction of the cartridge, and the inclination thereof is set to be substantially the same angle as the insertion angle of the process cartridge. The dowel 13*a* (13*e*) is disposed on the extension of the lengthwise guide 12*a* (12*b*) extending in the insertion direction of this process cartridge. Also, the short guide 13*d* (13*b*) is disposed in a direction substantially parallel to the lengthwise guide 12*a* (12*b*). That is, the fifth and sixth projections are provided upstream of the first and second projections, respectively, with respect to the direction in which the process cartridge B is mounted on the main body.

[Mounting Means for the Process Cartridge]

Figure 6:
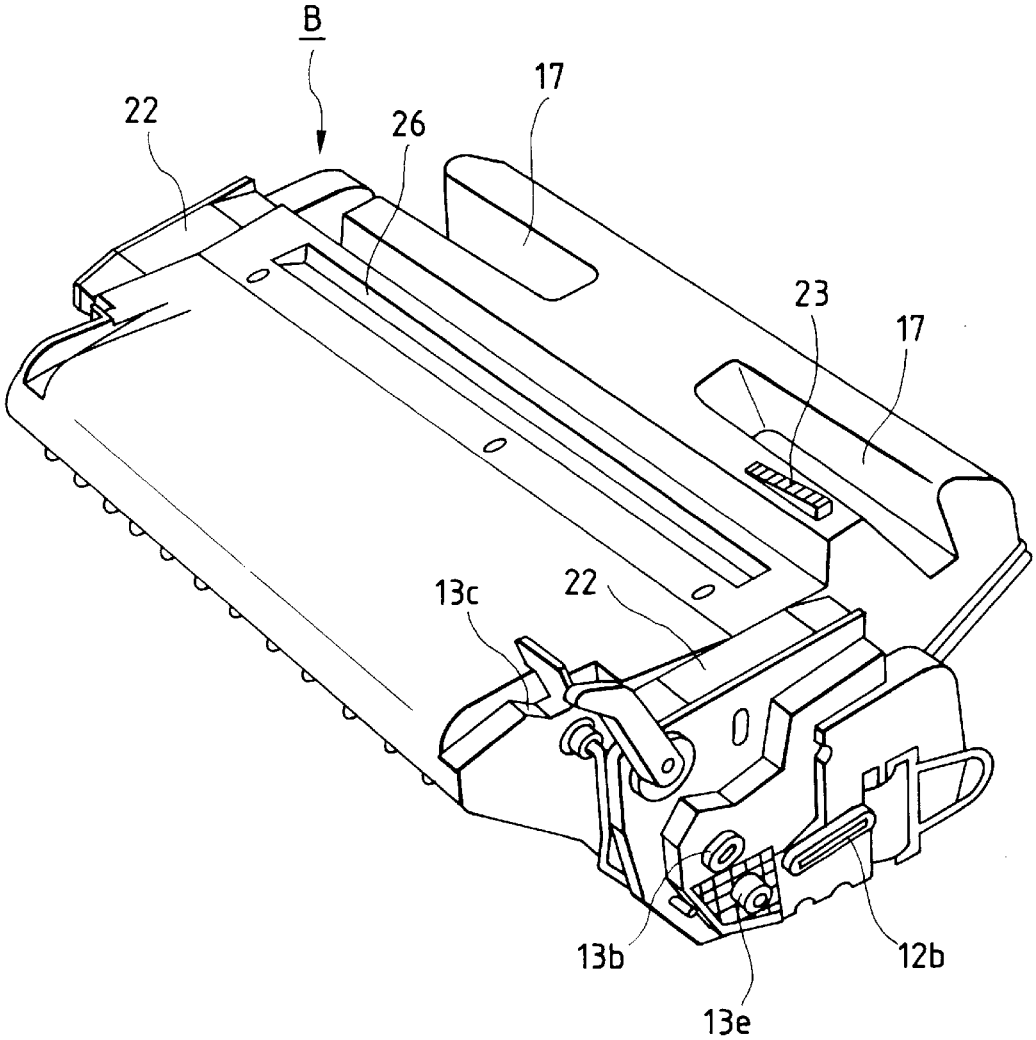
FIG. 6 is a perspective view of the process cartridge as it is seen from above it.
Figure 7:
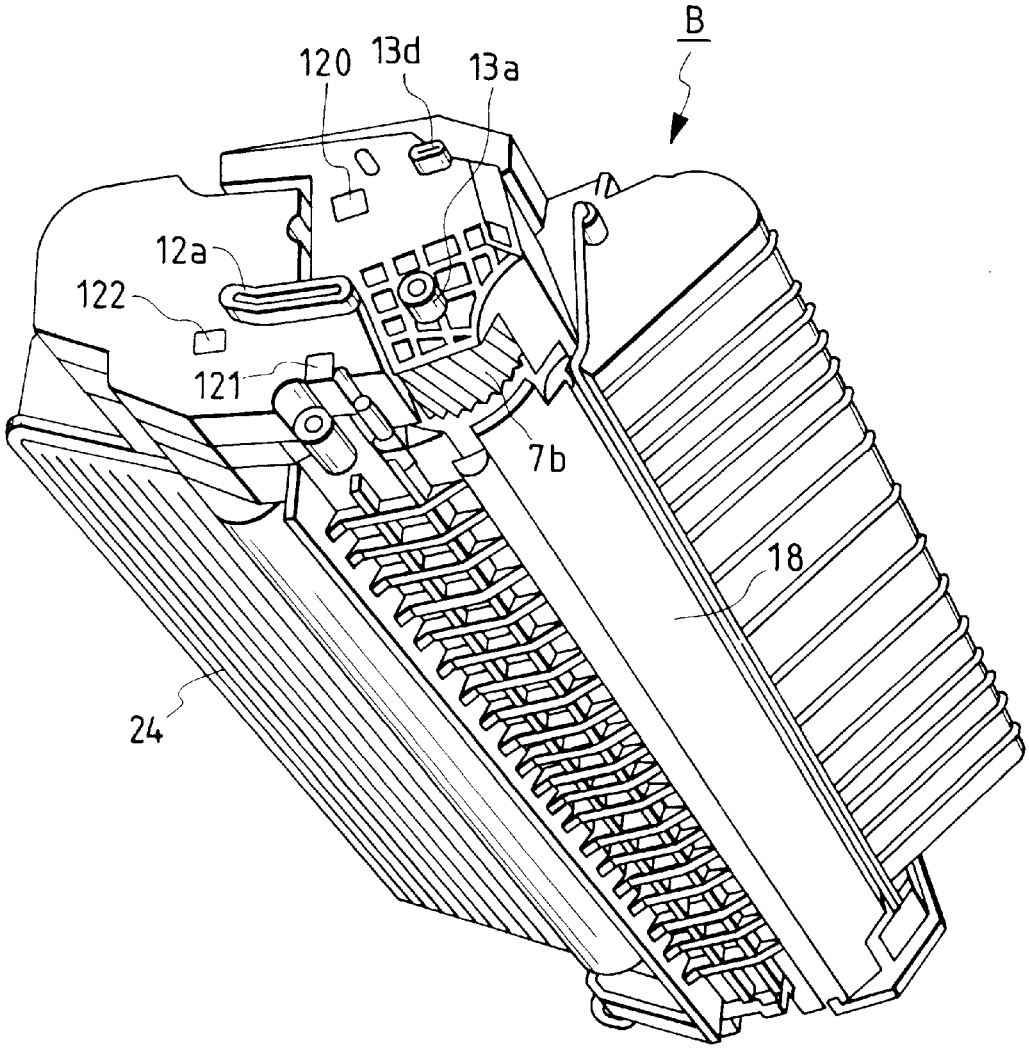
FIG. 7 is a perspective view of the process cartridge as it is seen from below it.
Figure 8:
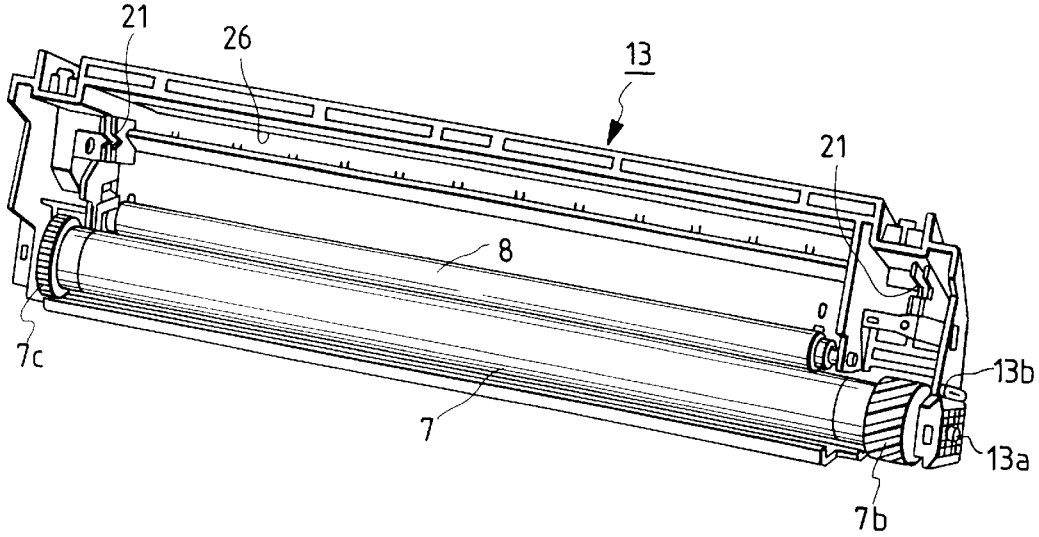
FIG. 8 is a perspective view of a cleaning unit.
Figure 11:
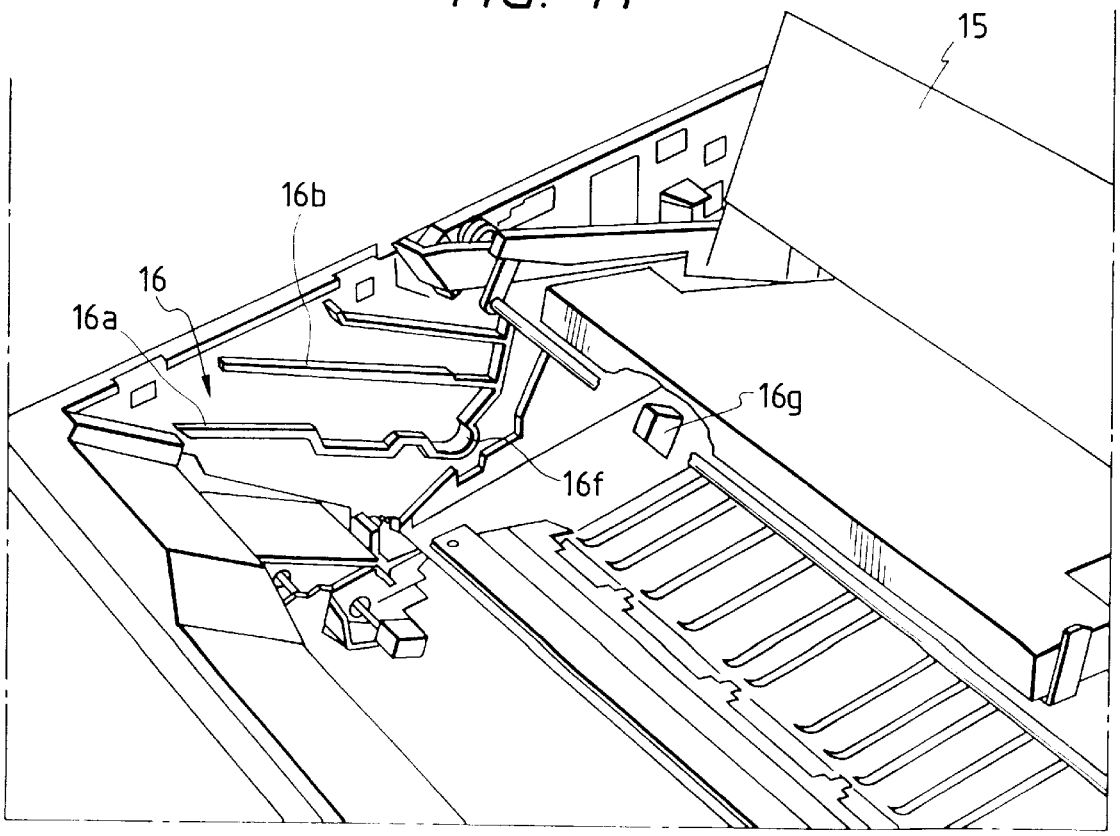
FIG. 11 is a perspective view of the mounting portion of the process cartridge.
Figure 12:
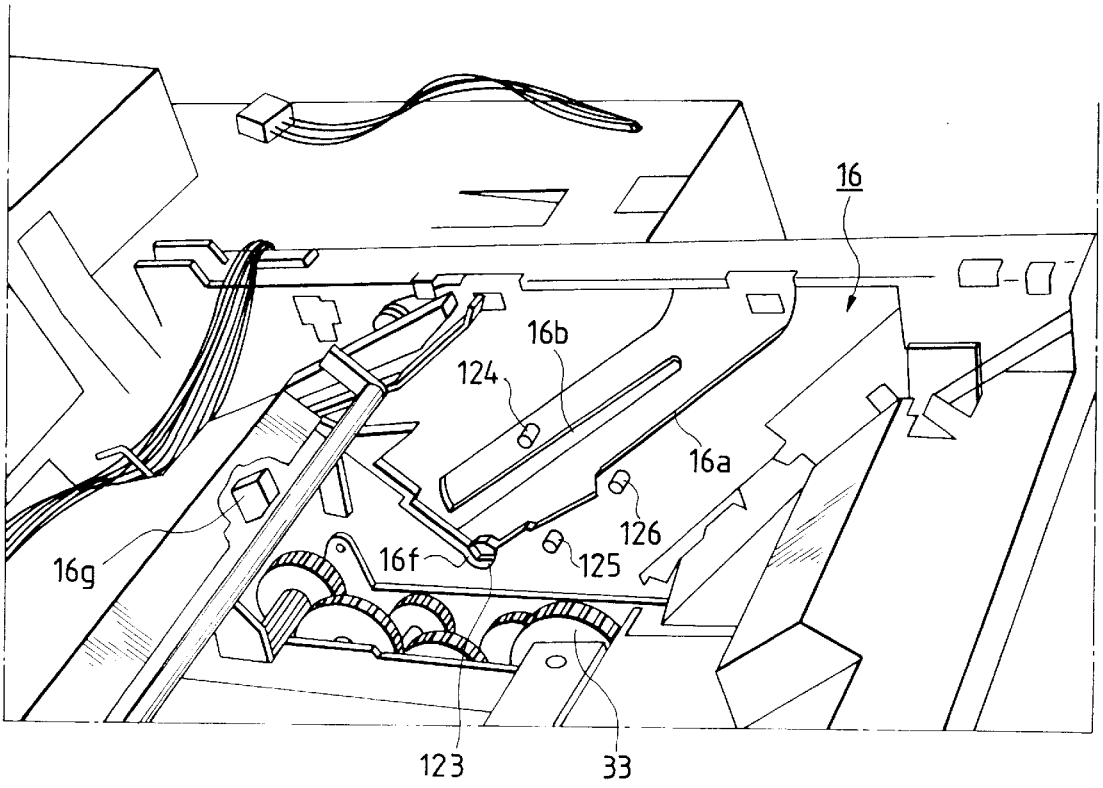
FIG. 12 is a perspective view of the mounting portion of the process cartridge.

In FIG. 1, when an openable-closable member 15 is counter-clockwisely rotated and opened about a support shaft 15*a*, it will be seen that a cartridge mounting space is provided as shown in FIGS. 11 and 12. Cartridge mounting guide members 16 as cartridge mounting means are attached to the left and right inner sides of the main body 14. These left and right guide members 16 are provided with two mutually opposed guide portions 16*a* and 16*b* for guiding the dowels 13*a*, 13*e*, the lengthwise guides 12*a*, 12*b* and the short guides 13*d*, 13*b* on the opposite sides of the process cartridge B shown in FIGS. 4 and 5 or FIGS. 6 and 7, and the process cartridge B is inserted along these guide portions 16*a* and 16*b*. The dowels 13*a* and 13*e* fit to a positioning portion 16*f* and the upper left and right rotation receiving portions 13*c* of the cleaning frame 13 shown in FIG. 6 are supported by a rotation stopping portion 16*g* below the optical means 1 of the main body, and then the openable-closable member 15 is closed. Thus, the positioning and mounting of the process cartridge B with respect to the laser beam printer A is completed.

By this positioning and mounting, a drum gear (bevel gear) 7*b* mounted by being forced into or caulked on one end portion of the photosensitive drum 7 is brought into meshing engagement with a driving gear 33 (see FIG. 12) on the main body and a transmission gear (spur gear) 7*c* mounted on the other end portion of the photosensitive drum 7 is brought into meshing engagement with a gear (not shown), fixed to the core shaft of the transfer roller 4. Also, the sleeve gear (bevel gear) 9*g* of the developing roller 9*c* is in meshing engagement with the drum gear 7*b* of the photosensitive drum 7.

Accordingly, the rotative driving force of the driving gear 33 on the main body 14 is transmitted to the drum gear 7*b* to rotate the photosensitive drum 7 and to transmit the driving force to the developing roller gear 9*g* through the drum gear 7*b*, whereby the developing roller 9*c* is rotated. Further, the driving force is transmitted to the gear of the transfer roller through the transmission gear 7*c* of the photosensitive drum 7 to rotate the transfer roller 4.

As shown in FIGS. 3 to 6, a grip portion 27 and ribs 23 and 24 are provided so that the user can easily hold the process cartridge 13 during the mounting or dismounting thereof. Further, the process cartridge B is provided with a drum shutter 18 (see FIG. 3) openable or closable in response to the mounting or dismounting of the cartridge with respect to the image forming apparatus A, and when the process cartridge B is removed from the image forming apparatus A, the shutter 18 is automatically closed to thereby protect the photosensitive drum 7.

The relation between the mounting guide member on the main body 14 and the guide on the process cartridge B during the mounting of the process cartridge B will now be described in greater detail with reference to FIGS. 13 to 18, which are schematic views showing the state from after the process cartridge B begins to be inserted until it is located at a predetermined position. The side surface of the whole process cartridge B is shown in only FIGS. 13 and 18, and the mounting guide member on the main body 14 side is indicated by phantom line. Also, in FIGS. 14 to 17 which show the course of insertion of the process cartridge B, for the sake of simplification, only the three projections (dowels 13*a*, 13*e*, lengthwise guides 12*a*, 12*b* and short guides 13*d*, 13*b*) of the process cartridge B are shown and the other portions are omitted.

Figure 13:
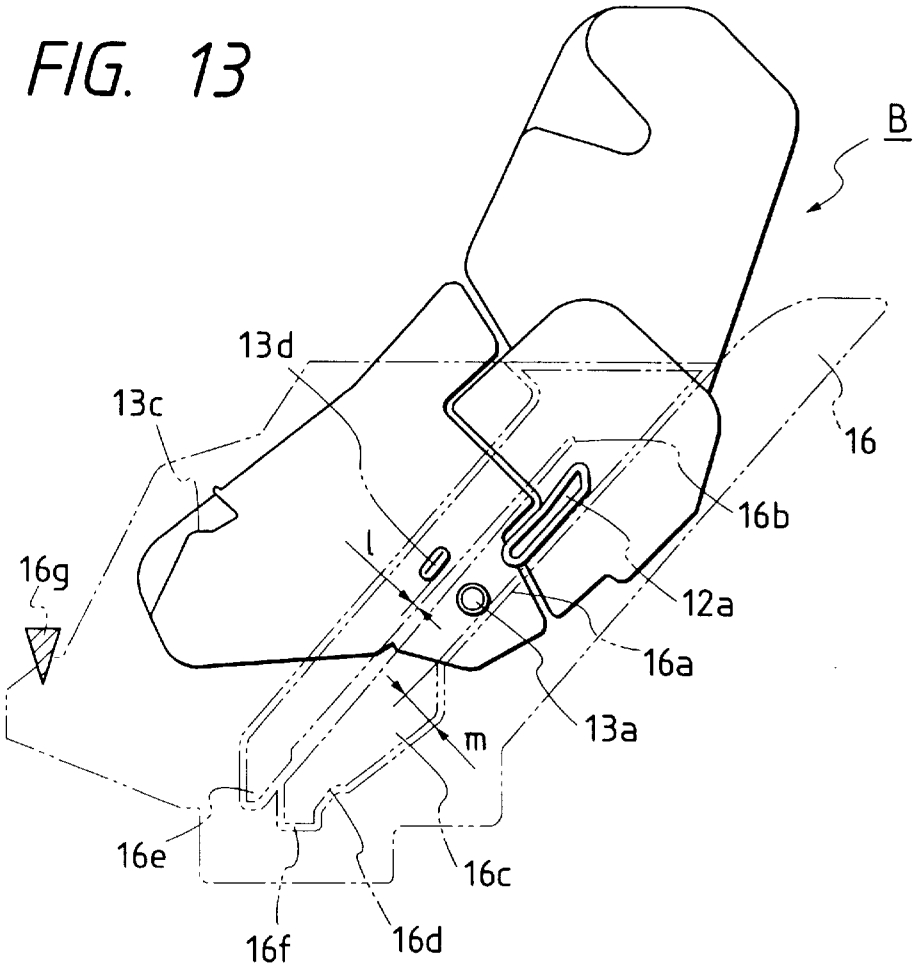
FIG. 13 is a side view for illustrating a mounting system for the process cartridge.

First, when as shown in FIG. 13, the process cartridge B is inserted into the main body 14, the dowel 13*a* (13*e*) and lengthwise guide 12*a* (12*b*) of the process cartridge B are slid and guided on the guide portion 16*a*. At this time, the short guide 13*d* (13*b*) is not guided by the guide portion 16*b* and is spaced apart by a predetermined spacing or gap λ from the lower surface side of the guide portion 16*b*.

Figure 14:
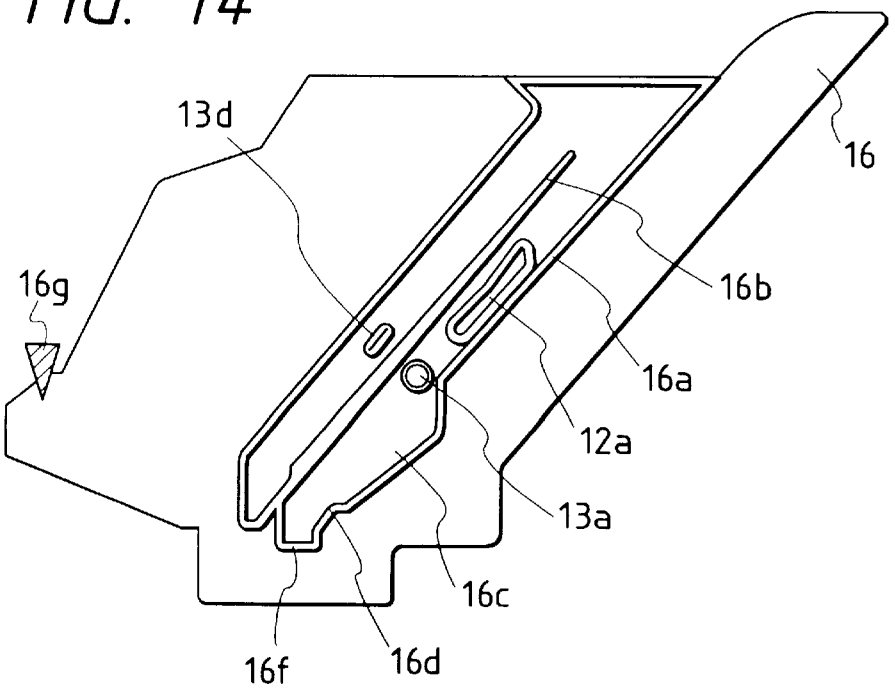
FIG. 14 is a side view for illustrating the mounting system for the process cartridge.

When the process cartridge B assumes a state as shown in FIG. 14, the dowel 13*a* (13*e*) comes to an escape 16*c* formed in the mounting guide member 16. This escape 16*c* of the mounting guide member 16 is for letting the lengthwise guide 12*a* (12*b*) escape when the process cartridge B has come to a predetermined position (see FIG. 17). The depth m of the escape is set to be greater than the aforementioned spacing λ (λ<m).

Figure 15:
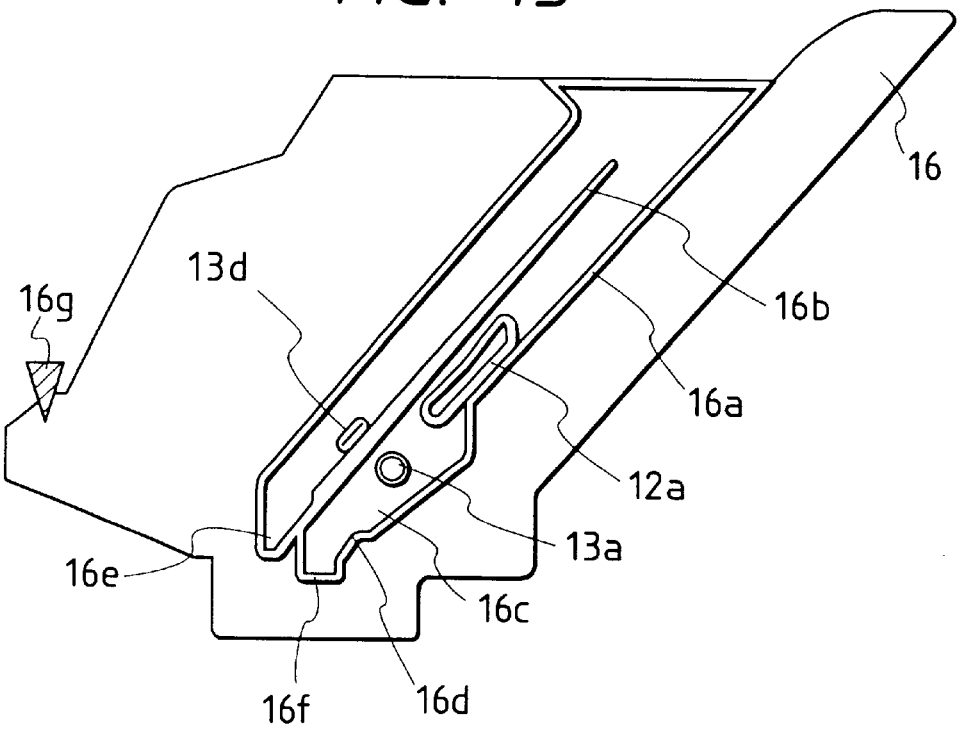
FIG. 15 is a side view for illustrating the mounting system for the process cartridge.

Accordingly, when the process cartridge B advances to a state as shown in FIG. 15, the short guide 13*d* (13*b*) comes into contact with the guide portion 16*b* before the dowel 13*a* (13*e*) of the process cartridge B arrives at the lower edge of the escape 16*c*. That is, the lengthwise guide 12*a* (12*b* ) and the short guide 13*d* (13*b*) provide an insertion guide for the process cartridge B, whereby the shock by the level difference or the like of the process cartridge B is alleviated.

Figure 16:
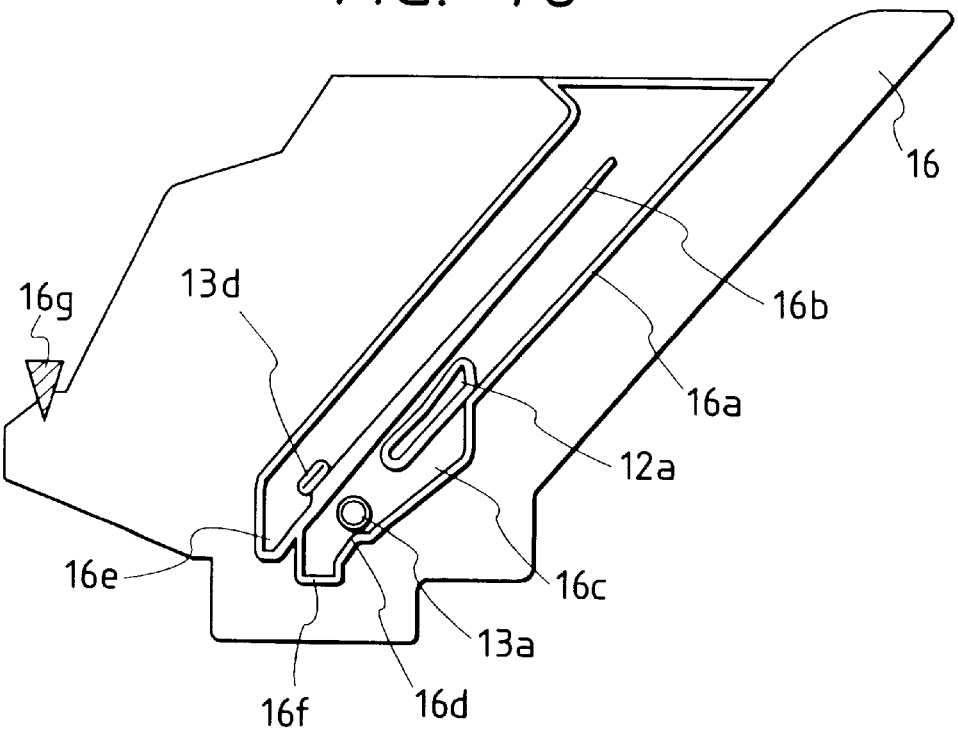
FIG. 16 is a side view for illustrating the mounting system for the process cartridge.

When the process cartridge B further advances to a state as shown in FIG. 16, the lengthwise guide 12*a* (12*b*) of the process cartridge B now comes to the aforedescribed escape 16*c* of the mounting guide member 16. Thereupon, the dowel 13*a* (13*e*) of the process cartridge B becomes along the guide portion 16*d*. At this time, the insertion guide for the process cartridge B is provided by the dowel 13*a* (13*e*) and the short guide 13*d* (13*b*).

Figure 17:
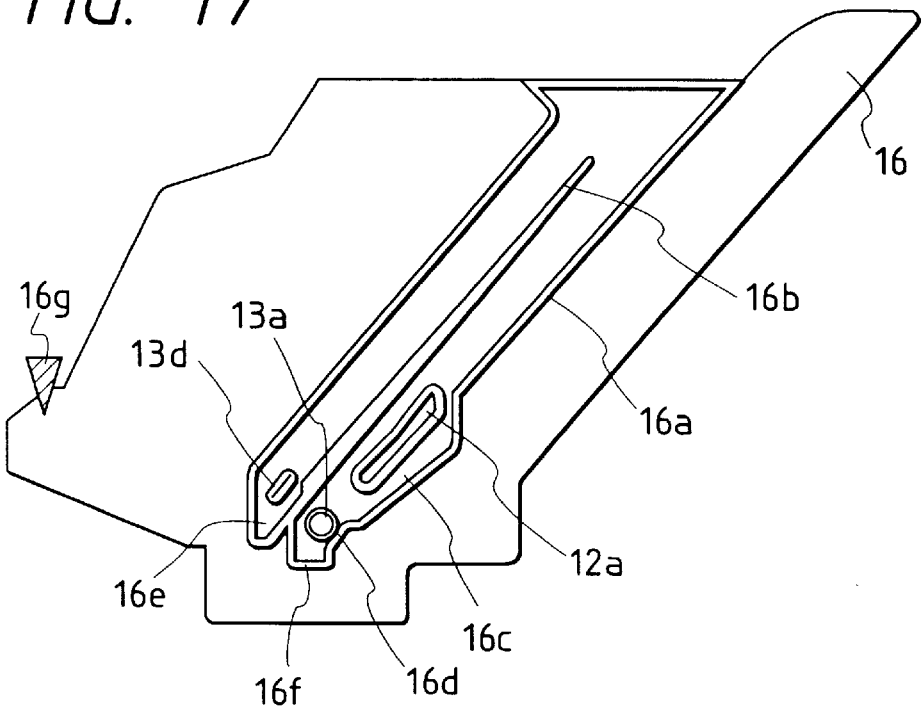
FIG. 17 is a side view for illustrating the mounting system for the process cartridge.
Figure 18:
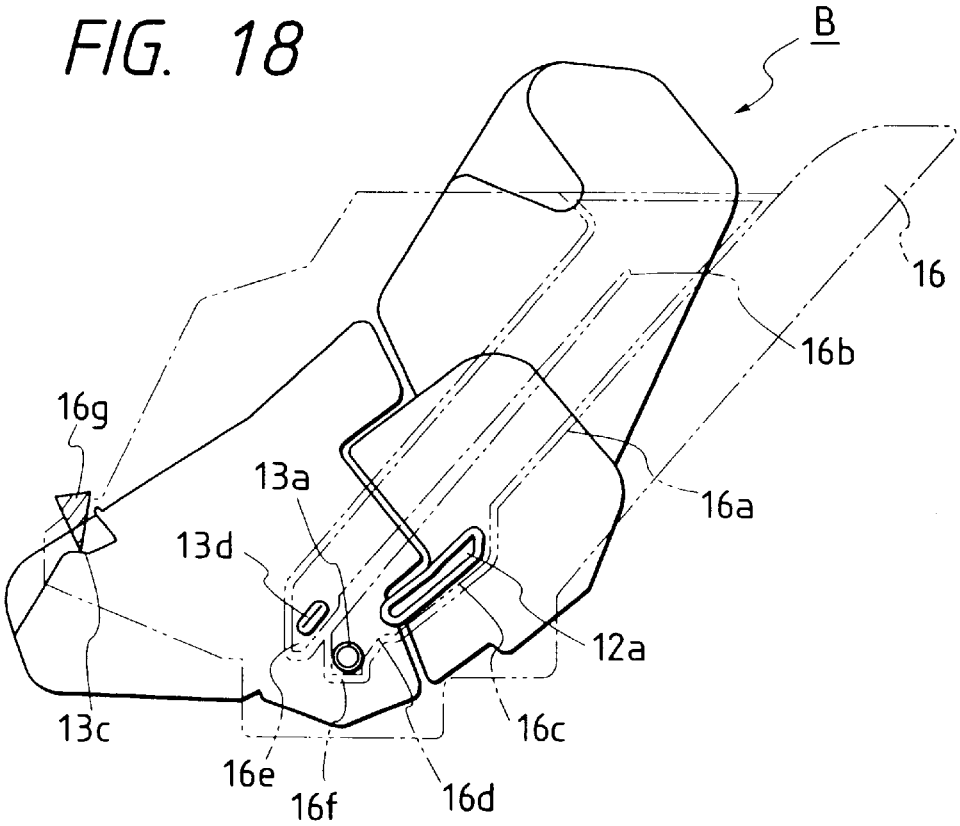
FIG. 18 is a side view for illustrating the mounting system for the process cartridge.

When the process cartridge B advances to a state as shown in FIG. 17, the short guide 13*d* (13*b*) now comes to the escape 16*e* of the mounting guide member 16. Only the dowel 13*a* (13*e*) becomes along the guide portion 16*d* for a short time for this short guide 13*d* (13*b*) to escape, and lastly the dowel 13*a* (13*e*) goes into the positioning portion 16*f* which is a groove in the mounting guide member 16 (see FIG. 18). On the other hand, the process cartridge B is heavier in the rear portion in the direction of mounting as viewed from the dowel 13*a* (13*e*), i.e., the developing unit, than in the cleaning unit. Therefore, the rotation receiving portion 13*c* formed on the cleaning frame 13 is supported by a rotation stopping portion 16*g* (see FIG. 18) formed on the main body 14 and the position of whole of the process cartridge B is determined. Thereby, the center (dowel 13*a* (13*e*)) of the process cartridge B is determined at a point, and the other guides (the lengthwise guide 12*a* (12*b*) and the short guide 13*d* (13*b*)) do not contact with any portion of the mounting guide portion 16 of the main body 14.

The positional relation between the rotation receiving portion 13*c* and the rotation stopping portion 16*g* is selected such that the moment created by the driving of process cartridge B is received. Further, the distances between the rotation receiving portion 13*c* and the center of the dowel 13*a* (13*e*) and between the rotation stopping portion 16*g* and the center of the dowel 13*a* (13*e*) are set to be longer than the distances between the lengthwise guide 12*a* (12*b* ) and the center of the dowel 13*a* (13*e*) and between the short guide 13*d* (13*b*) and the center of the dowel 13*a* (13*e*). Therefore, the posture of the process cartridge B during driving becomes more stable.

[Prevention of the Wrong Insertion of the Process Cartridge]

A construction for preventing the process cartridge from being inserted with its direction of mounting reversed will now be described with reference to FIGS. 4, 5 and 19. When the distance between the dowel 13*a* , 13*e* and the short guide 13*d* , 13*b* in a direction perpendicular to the mounting direction of the process cartridge B is defined as f (see FIG. 4) on the left side of the process cartridge B and defined as h (see FIG. 5) on the right side thereof, they are not equal (f≠h). In the present embodiment, for example, f is of the order of 30 mm and h is of the order of 45 mm. The outer diameter of the dowel 13*a* and the outer diameter of the dowel 13*e* may be equal to each other.

Figure 19:
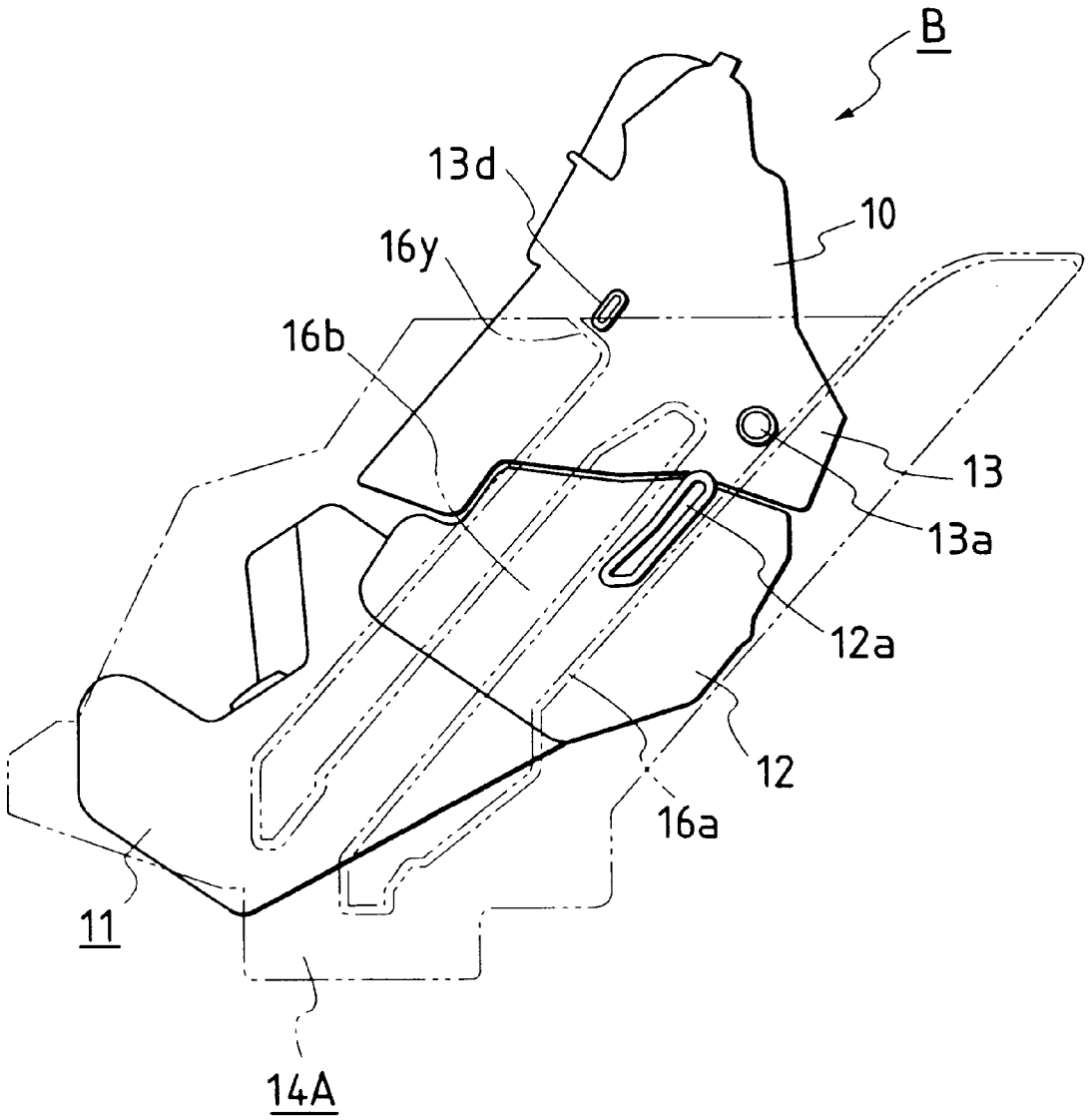
FIG. 19 is a side view for illustrating the mounting system for the process cartridge.

In this construction, when the process cartridge B is inserted into the main body 14 with the developing unit ahead as shown in FIG. 19, the short guide 13*d* strikes against the dash portion 16*y* of the mounting guide 16 of the main body 14 and the process cartridge cannot be inserted any further. Accordingly, by adopting such a construction, incorrect insertion done by the user inserting the process cartridge into the main body with the longitudinal direction thereof reversed can be prevented without any increase in cost.

More preferably, the diameter d of the dowel 13*e* on one side may be changed from the diameter of the other side dowel (see the reference character 13*a* in FIG. 4). For example, the diameter d of the dowel 13*e* may be of the order of 17 mm and the diameter of the other dowel 13*a* may be of the order of 10 mm. In accordance therewith, the lengthwise guide 12*b* on the side surface on which the dowel 13*e* is provided must also be made large, and the guide portion (not shown) of the mounting guide of the main body 14 which guides the large dowel 13*e* and lengthwise guide 12*b* must also be made wide. By adopting the construction as described above, incorrect insertion done by the user inserting the process cartridge into the main body with its lateral direction reversed can be further prevented.

[Construction of Electrical Contacts]

The structure of contacts for electrically connecting the process cartridge B and the main body A of image forming apparatus together when the former is mounted on the latter will hereinafter be described with reference to FIGS. 5 and 12.

The process cartridge B is provided with a plurality of electrical contacts as shown. That is, four contacts, i.e., an electrically conductive ground contacts 119 electrically connected to the photosensitive drum 7 to ground the photosensitive drum 7 between it and the main body A, an electrically conductive charging bias contact 120 electrically connected to the charging roller shaft 8*a* to apply a charging bias from the main body A to the charging roller 8, an electrically conductive bias contact 121 electrically connected to the developing roller 9*b* to apply a developing bias from the main body A to the developing roller 9*b*, and an electrically conductive toner detecting contact (detected contact) 122 electrically connected to an antenna wire, are provided so as to be exposed from a side surface (the right side surface) of the cartridge frame. The toner detecting contact 122 serves also as a cartridge detected contact for causing the main body A to detect that the process cartridge B has been mounted on the main body A. The four contacts 119 to 122 are all provided on the right side surface of the cartridge frame with such a distance between adjacent ones of them such that the adjacent ones do not electrically leak.

As previously described, the distance h between the dowel 13*a* and short guide 13*d* provided on the right side surface of the cartridge frame is greater than the distance f between the dowel 13*e* and short guide 13*b* provided on the left side surface of the cartridge frame. Also, the dowel 13*a* on the right side surface is smaller than the dowel 13*e* on the left side surface. Accordingly, the aforedescribed four contacts 119 to 122 can be efficiently disposed on the right side surface of the cartridge frame and therefore, the cartridge becomes compact. That is, the charging bias contact 120 is disposed at a location substantially sandwiched between the dowel 13*a* (first projection) and the short guide 13*d* (third projection).

Also, the ground contact 119 is provided on a line coaxial with the axis of the electrophotographic photosensitive member 7, and the developing bias contact 121 and the detected contact 122 are disposed on the side opposite to the side on which the charging bias contact 120 is disposed, relative to a straight line linking the dowel 13*a* (first projection) and the lengthwise guide 12*a* (fifth projection) together, in a direction orthogonal to the direction in which the process cartridge B is mounted or dismounted with respect to the main body A.

On the other hand, on one inner side surface of the cartridge mounting space of the image forming apparatus A, as shown in FIG. 12, there are provided four contact members (a ground contact member 123 for contacting with the ground contact 119, a charging contact member 124 for contacting the charging bias contact 120, a developing contact member 125 for contacting the developing bias contact 121, and a toner detecting contact member 126 for contacting the toner detecting contact 122) capable of being connected to the aforementioned respective contacts 119 to 122 when the process cartridge B is mounted.

As shown in FIG. 12, the ground contact member 123 is provided correspondingly to the groove 16*f*. Also, the developing contact member 125 and the toner detecting contact member 126 are provided below the first guide portion 16*a*. Also, the charging bias contact 120 is provided above the second guide portion 16*b*. When the cartridge B is guided by the guide member 16 and is mounted at a predetermined mounting position, the respective contacts are reliably connected to the respective contact members.

Also, while the process cartridge B shown in the above-described embodiment has been shown with respect to a case where a monochromatic image is formed, the process cartridge according to the present invention can also be suitably applied to a cartridge provided with a plurality of developing means and forming a plurality of colors of image (e.g. a two-color image, a three-color image or a full color image).

The electrophotographic photosensitive member is not restricted to the photosensitive drum, but for example, the following variations are included. First, a photoconductive member can be used as the photosensitive member, which includes, for example, amorphous silicon, amorphous selenium, zinc oxide, titanium oxide and organic photoconductive member (OPC). Also, the shape for carrying the photosensitive member is a drum-like shape which is, for example, a photoconductive member deposited by evaporation or applied by coating onto a cylinder of an aluminum alloy or the like.

Also, as the developing method, it is possible to use various developing methods such as the conventional two-component magnetic brush developing method, a cathcade developing method, a touch-down developing method and a cloud developing method.

Also, as the construction of the charging means, the so-called contact charging method is used in the above-described embodiment, but of course a construction in which a metallic shield of aluminum or the like is applied to the three sides of a tungsten wire heretofore can be used, and positive or negative ions created by a high voltage being applied to the tungsten wire are moved to the surface of the photosensitive drum to thereby uniformly charge the surface of the photosensitive drum. The charging means may be, besides the aforedescribed roller type, a blade type (charging blade), a pad type, a block type, a rod type, a wire type or the like.

Also, as the cleaning method for the toner remaining on the photosensitive drum, cleaning means may be constructed by the use of a blade, a fur brush, a magnetic brush or the like.

As described above, according to the present invention, there can be provided a process cartridge and an electrophotographic image forming apparatus which can prevent the incorrect mounting of the process cartridge with respect to the main body of electrophotographic image forming apparatus.

Also, according to the present invention, there can be provided a process cartridge and an electrophotographic image forming apparatus which permit a ground contact, a charging bias contact, a developing bias contact and a detected contact to be efficiently disposed on the end surface of a cartridge frame.

What is claimed is:

1. A process cartridge removably mounted on a main body of an electrophotographic image forming apparatus, said process cartridge comprising:

an electrophotographic photosensitive member;

process means for acting on said electrophotographic photosensitive member;

a cartridge frame;

a first projection guided by said main body when said process cartridge is mounted on or dismounted from said main body, said first projection protruding outwardly from one end surface of said cartridge frame which intersects with the axial direction of said electrophotographic photosensitive member to be coaxial with said electrophotographic photosensitive member;

a second projection guided by said main body when said process cartridge is mounted on or dismounted from said main body, said second projection projecting from the other end surface opposite to said one end surface of said cartridge frame which intersects with the axial direction of said electrophotographic photosensitive member to be coaxial with said electrophotographic photosensitive member;

a third projection guided by said main body when said process cartridge is mounted on or dismounted from said main body, said third projection protruding outwardly from said one end surface of said cartridge frame to be located substantially above said first projection in a state in which said process cartridge is mounted on said main body; and a fourth projection guided by said main body when said process cartridge is mounted on or dismounted from said main body, said fourth projection protruding outwardly from said other end surface of said cartridge frame to be located substantially above said second projection in a state in which said process cartridge is mounted on said main body;

wherein the distance between said first projection and said third projection is different from the distance between said second projection and said fourth projection.

2. A process cartridge according to claim 1, wherein said first projection and said second projection have a cylindrical shape, and said third projection and said fourth projection have a long cylindrical shape, and the distance between the center of said first projection and a lower surface of said third projection is different from the distance between the center of said second projection and a lower surface of said fourth projection.

3. A process cartridge according to claim 1, wherein said first projection and said second projection have a cylindrical shape, and said third projection and said fourth projection have a long cylindrical shape, and the distance between the outer peripheral surface of said first projection and a lower surface of said third projection is different from the distance between the outer peripheral surface of said second projection and a lower surface of said fourth projection.

4. A process cartridge removably mounted on a main body of an electrophotographic image forming apparatus, said process cartridge comprising:

an electrophotographic photosensitive member:

process means for acting on said electrophotographic photosensitive member;

a cartridge frame;

a first projection guided by said main body when said process cartridge is mounted on or dismounted from said main body, said first projection protruding outwardly from one end surface of said cartridge frame which intersects with the axial direction of said electrophotographic photosensitive member to be coaxial with said electrophotographic photosensitive member;

a second projection guided by said main body when said process cartridge is mounted on or dismounted from said main body, said second projection projecting from the other end surface opposite to said one end surface of said cartridge frame which intersects with the axial direction of said electrophotographic photosensitive member to be coaxial with said electrophotographic photosensitive member;

a third projection guided by said main body when said process cartridge is mounted on or dismounted from said main body, said third projection protruding outwardly from said one end surface of said cartridge frame to be located substantially above said first projection in a state in which said process cartridge is mounted on said main body; and a fourth projection guided by said main body when said process cartridge is mounted on or dismounted from said main body, said fourth projection protruding outwardly from said other end surface of said cartridge frame to be located substantially above said second projection in a state in which said process cartridge is mounted on said main body;

wherein the distance between said first projection and said third projection is different from the distance between said second projection and said fourth projection, wherein said first projection and said second projection have a cylindrical shape, and the outer diameter of said first projection differs from the outer diameter of said second projection.

5. A process cartridge according to claim 4, wherein said third projection and said fourth projection have a long cylindrical shape.

6. A process cartridge according to claim 5, wherein the distance between said first projection and said third projection is greater than the distance between said second projection and said fourth projection, and the outer diameter of said first projection is smaller than the outer diameter of said second projection.

7. A process cartridge according to claim 6, further comprising charging means as said process means for charging said electrophotographic photosensitive member, and a charging bias contact for receiving a bias voltage supplied to said charging means from said main body when said process cartridge is mounted on said main body, said charging bias contact being disposed at a location substantially sandwiched between said first projection and said third projection.

8. A process cartridge according to claim 7, further comprising: a fifth projection guided by said main body when said process cartridge is mounted on or dismounted from said main body, and provided upstream of said first projection in the mounting/dismounting direction of said process cartridge; and a sixth projection guided by said main body when said process cartridge is mounted on or dismounted from said main body, and provided upstream of said second projection in the mounting/dismounting direction of said process cartridge.

9. A process cartridge according to claim 8, further comprising developing means as said process means for developing a latent image formed on said electrophotographic photosensitive member, a ground contact for grounding said electrophotographic photosensitive member and said main body when said process cartridge is mounted on said main body, a developing bias contact for said developing means to receive a bias voltage from said main body, and a detected contact for said main body to detect whether said process cartridge is mounted on said main body, wherein said ground contact is provided coaxial with said electrophotographic photosensitive member, said developing bias contact and said detected contact are disposed on the side opposite to the side on which said charging bias contact is disposed, relative to a line linking said first projection and said fifth projection together, in a direction orthogonal to the direction in which said process cartridge is mounted on or dismounted from said electrophotographic image forming apparatus.

10. A process cartridge, removably mounted on a main body of an electrophotographic image forming apparatus, said process cartridge comprising:

an electrophotographic photosensitive member;

process means for acting on said electrophotographic photosensitive member;

a cartridge frame;

a first projection guided by said main body when said process cartridge is mounted on or dismounted from said main body, said first projection protruding outwardly from one end surface of said cartridge frame which intersects with the axial direction of said electrophotographic photosensitive member to be coaxial with said electrophotographic photosensitive member;

a second projection guided by said main body when said process cartridge is mounted on or dismounted from said main body, said second projection projecting from the other end surface opposite to said one end surface of said cartridge frame which intersects with the axial direction of said electrophotographic photosensitive member to be coaxial with said electrophotographic photosensitive member;

a third projection guided by said main body when said process cartridge is mounted on or dismounted from said main body, said third projection protruding outwardly from said one end surface of said cartridge frame to be located substantially above said first projection in a state in which said process cartridge is mounted on said main body; and a fourth projection guided by said main body when said process cartridge is mounted on or dismounted from said main body, said fourth projection protruding outwardly from said other end surface of said cartridge frame to be located substantially above said second projection in a state in which said process cartridge is mounted on said main body;

wherein the distance between said first projection and said third projection is different from the distance between said second projection and said fourth projection, wherein said process cartridge comprises said electrophotographic photosensitive member and at least one of charging means for charging said electrophotographic photosensitive member, developing means for developing a latent image formed on said electrophotographic photosensitive member, and cleaning means for removing any toner remaining on said electrophotographic photosensitive member, as said process means, integrally made into a cartridge removably mounted on said main body.

11. A process cartridge removably mounted on a main body of an electrophotographic image forming apparatus, said process cartridge comprising:

an electrophotographic photosensitive member;

a charge member for charging said photosensitive member;

a developing roller for supplying a developing agent to said photosensitive member;

a first frame for supporting said photosensitive member and said charge member;

a second frame for supporting said developing roller and rockably connected to said first frame;

a first projection of cylindrical shape guided by said main body when said process cartridge is mounted on or dismounted from said main body, said first projection protruding outwardly from one end surface of said process cartridge which intersects with the axial direction of said electrophotographic photosensitive member to be coaxial with said electrophotographic photosensitive member;

a second projection of cylindrical shape guided by said main body when said process cartridge is mounted on or dismounted from said main body, said second projection projecting from the other end surface opposite to said one end surface of said process cartridge which intersects with the axial direction of said electrophotographic photosensitive member to be coaxial with said electrophotographic photosensitive member;

a third projection of long cylindrical shape guided by said main body when said process cartridge is mounted on or dismounted from said main body, said third projection protruding outwardly from said one end surface of said process cartridge to be located substantially above said first projection in a state in which said process cartridge is mounted on said main body; and a fourth projection of long cylindrical shape guided by said main body when said process cartridge is mounted on or dismounted from said main body, said fourth projection protruding outwardly from said other end surface of said process cartridge to be located substantially above said second projection in a state in which said process cartridge is mounted on said main body;

wherein the distance between said first projection and said third projection is different from the distance between said second projection and said fourth projection.

12. A process cartridge according to claim 11, wherein the distance between the center of said first projection and a lower surface of said third projection is different from the distance between the center of said second projection and a lower surface of said fourth projection.

13. A process cartridge according to claim 11, wherein the distance between the outer peripheral surface of said first projection and a lower surface of said third projection is different from the distance between the outer peripheral surface of said second projection and a lower surface of said fourth projection.

14. A process cartridge removably mounted on a main body of an electrophotographic image forming apparatus, said process cartridge comprising:

an electrophotographic photosensitive member;

a charge member for charging said photosensitive member;

a developing roller for supplying a developing agent to said photosensitive member;

a first frame for supporting said photosensitive member and said charge member;

a second frame for supporting said developing roller and rockably connected to said first frame;

a first projection of cylindrical shape guided by said main body when said process cartridge is mounted on or dismounted from said main body, said first projection protruding outwardly from one end surface of said process cartridge which intersects with the axial direction of said electrophotographic photosensitive member to be coaxial with said electrophotographic photosensitive member;

a second projection of cylindrical shape guided by said main body when said process cartridge is mounted on or dismounted from said main body, said second projection projecting from the other end surface opposite to said one end surface of said process cartridge which intersects with the axial direction of said electrophotographic photosensitive member to be coaxial with said electrophotographic photosensitive member;

a third projection of long cylindrical shape guided by said main body when said process cartridge is mounted on or dismounted from said main body, said third projection protruding outwardly from said one end surface of said process cartridge to be located substantially above said first projection in a state in which said process cartridge is mounted on said main body; and a fourth projection of long cylindrical shape guided by said main body when said process cartridge is mounted on or dismounted from said main body, said fourth projection protruding outwardly from said other end surface of said process cartridge to be located substantially above said second projection in a state in which said process cartridge is mounted on said main body;

wherein the distance between said first projection and said third projection is different from the distance between said second projection and said fourth projection, wherein said cartridge further comprises charging means as process means for charging said electrophotographic photosensitive member, and a charging bias contact receiving a bias voltage supplied to said charging means from said main body when said process cartridge is mounted on said main body, said charging bias contact being disposed at a location substantially sandwiched between said first projection and said third projection.

15. A process cartridge according to claim 14, further comprising: a fifth projection guided by said main body when said process cartridge is mounted on or dismounted from said main body, and provided upstream of said first projection in the mounting/dismounting direction of said process cartridge; and a sixth projection guided by said main body when said process cartridge is mounted on or dismounted from said main body, and provided upstream of said second projection in the mounting/dismounting direction of said process cartridge.

16. A process cartridge according to claim 15, further comprising developing means as said process means for developing a latent image formed on said electrophotographic photosensitive member, a ground contact for grounding said electrophotographic photosensitive member and said main body when said process cartridge is mounted on said main body, a developing bias contact for said developing means to receive a bias voltage from said main body, and a detected contact for said main body to detect whether said process cartridge is mounted on said main body, wherein said ground contact is provided coaxial with said electrophotographic photosensitive member, and wherein said developing bias contact and said detected contact are disposed on the side opposite to the side on which said charging bias contact is disposed, relative to a line linking said first projection and said fifth projection together, in a direction orthogonal to the direction in which said process cartridge is mounted on or dismounted from said electrophotographic image forming apparatus.

17. An electrophotographic image forming apparatus for forming an image on a recording medium, comprising:

(a) mount means for removably mounting a process cartridge onto a main body of said image forming apparatus, said process cartridge including:

an electrophotographic photosensitive member;

process means for acting on said electrophotographic photosensitive member;

a cartridge frame;

a first projection guided by said main body when said process cartridge is mounted on or dismounted from said main body, said first projection protruding outwardly from one end surface of said cartridge frame which intersects with the axial direction of said electrophotographic photosensitive member to be coaxial with said electrophotographic photosensitive member;

a second projection guided by said main body when said process cartridge is mounted on or dismounted from said main body, said second projection protruding from the other end surface opposite to said one end surface of said cartridge frame which intersects with the axial direction of said electrophotographic photosensitive member to be coaxial with said electrophotographic photosensitive member;

a third projection guided by said main body when said process cartridge is mounted on or dismounted from said main body, said third projection protruding outwardly from said one end surface of said cartridge frame to be located substantially above said first projection in a state in which said process cartridge is mounted on said main body; and a fourth projection guided by said main body when said process cartridge is mounted on or dismounted from said main body, said fourth projection protruding outwardly from said other end surface of said cartridge frame to be located substantially above said second projection in a state in which said process cartridge is mounted on said main body;

wherein the distance between said first projection and said third projection is different from the distance between said second projection and said fourth projection; and (b) convey means for conveying the recording medium.

18. An electrophotographic image forming apparatus according to claim 17, wherein said first projection and said second projection have a cylindrical shape, and said third projection and said fourth projection have a long cylindrical shape, and wherein the distance between the center of said first projection and a lower surface of said third projection is different from the distance between the center of said second projection and a lower surface of said fourth projection.

19. An electrophotographic image forming apparatus according to claim 17, wherein said first projection and said second projection have a cylindrical shape, and said third projection and said fourth projection have a long cylindrical shape, and the distance between the outer peripheral surface of said first projection and a lower surface of said third projection is different from the distance between the outer peripheral surface of said second projection and a lower surface of said fourth projection.

20. An electrophotographic image forming apparatus for forming an image on a recording medium, comprising:

(a) mount means for removably mounting a process cartridge onto a main body of said image forming apparatus, said process cartridge including:

an electrophotographic photosensitive member;

a charge member for charging said photosensitive member;

a developing roller for supplying a developing agent to said photosensitive member;

a first frame for supporting said photosensitive member and said charge member;

a second frame for supporting said developing roller and rockably connected to said first frame;

a first projection of cylindrical shape guided by said main body when said process cartridge is mounted on or dismounted from said main body, said first projection protruding outwardly from one end surface of said process cartridge which intersects with the axial direction of said electrophotographic photosensitive member to be coaxial with said electrophotographic photosensitive member;

a second projection of cylindrical shape guided by said main body when said process cartridge is mounted on or dismounted from said main body, said second projection projecting from the other end surface opposite to said one end surface of said process cartridge which intersects with the axial direction of said electrophotographic photosensitive member to be coaxial with said electrophotographic photosensitive member;

a third projection of long cylindrical shape guided by said main body when said process cartridge is mounted on or dismounted from said main body, said third projection protruding outwardly from said one end surface of said process cartridge to be located substantially above said first projection in a state in which said process cartridge is mounted on said main body; and a fourth projection of long cylindrical shape guided by said main body when said process cartridge is mounted on or dismounted from said main body, said fourth projection protruding outwardly from said other end surface of said process cartridge to be located substantially above said second projection in a state in which said process cartridge is mounted on said main body;

wherein the distance between said first projection and said third projection is different from the distance between said second projection and said fourth projection; and (b) convey means for conveying the recording medium.

21. An electrophotographic image forming apparatus according to claim 17 or 20, wherein said electrophotographic image forming apparatus is an electrophotographic printer.

22. An electrophotographic image forming apparatus according to claim 21, wherein said electrophotographic printer comprises a laser printer.

23. An electrophotographic image forming apparatus according to claim 17 or 20, wherein said electrophotographic image forming apparatus is an electrophotographic facsimile apparatus.

24. An electrophotographic image forming apparatus according to claim 17 or 20, wherein said electrophotographic image forming apparatus is an electrophotographic copying machine.

25. An electrophotographic image forming apparatus according to claim 20, wherein the distance between the center of said first projection and a lower surface of said third projection is different from the distance between the center of said second projection and a lower surface of said fourth projection.

26. An electrophotographic image forming apparatus according to claim 20, wherein the distance between the outer peripheral surface of said first projection and a lower surface of said third projection is different from the distance between the outer peripheral surface of said second projection and a lower surface of said fourth projection.

* * * * *

UNITED STATES PATENT AND TRADEMARK OFFICE

CERTIFICATE OF CORRECTION

PATENT NO. : 5,943,529

DATED : August 24, 1999

INVENTOR(S): SHIGEO MIYABE, ET AL.

It is certified that error appears in the above-identified patent and that said Letters Patent is hereby corrected as shown below:

Drawings:

ON SHEETS 1, 3, 4, AND 6 OF THE DRAWINGS

In Figures 1, 3, 4, and 6, reference numeral "17" should read --27--.

ON SHEET 4 OF THE DRAWINGS

In Figure 4, reference numeral "7" should read --17--.

ON SHEET 14 OF THE DRAWINGS

In Figure 19, reference numeral "14A" and the lead line therefrom should be deleted.

COLUMN 3,

Line 12, "respectively" should read --respectively,--.

COLUMN 6,

Line 47, "cartridge 13" should read --cartridge B--.

UNITED STATES PATENT AND TRADEMARK OFFICE

CERTIFICATE OF CORRECTION

PATENT NO. : 5,943,529

DATED : August 24, 1999

INVENTOR(S): SHIGEO MIYABE, ET AL.

It is certified that error appears in the above-identified patent and that said Letters Patent is hereby corrected as shown below:

COLUMN 8,

Line 3, "13d ," should read --13d,--.

Line 47, "8a" should be deleted.

Signed and Sealed this

Second Day of May, 2000

*Attest:*

Q. TODD DICKINSON

*Attesting Officer*

*Director of Patents and Trademarks*